United States Patent [19]

Parrott et al.

[11] Patent Number: 4,652,056

[45] Date of Patent: Mar. 24, 1987

[54] MINERAL CUTTING DEVICE

[75] Inventors: George A. Parrott, Sandal; Neil Preddy, Barnsley, both of England

[73] Assignee: Minnovation Limited, Wakefield, England

[21] Appl. No.: 730,668

[22] Filed: May 2, 1985

[30] Foreign Application Priority Data

May 4, 1984 [GB] United Kingdom ..... 8411527
Aug. 22, 1984 [GB] United Kingdom ..... 8421268
Apr. 2, 1985 [GB] United Kingdom ..... 8508629

[51] Int. Cl.[4] ..... E21C 35/22; E21F 5/02
[52] U.S. Cl. ..... 299/81; 299/17
[58] Field of Search ..... 299/81, 17; 175/393

[56] References Cited

U.S. PATENT DOCUMENTS 3,747,982 7/1973 Agnew et al. ..... 299/81
4,219,239 8/1980 Weikert et al. ..... 299/81
4,280,735 7/1981 Lobbe ..... 299/17 X

FOREIGN PATENT DOCUMENTS 1283777 11/1968 Fed. Rep. of Germany ..... 299/81
1006819 10/1965 United Kingdom .
1057830 2/1967 United Kingdom .
2041043 9/1980 United Kingdom ..... 299/81
2088441 6/1982 United Kingdom ..... 299/81
2104945 3/1983 United Kingdom ..... 299/81
2142064 1/1985 United Kingdom .
2142676A 1/1985 United Kingdom .

*Primary Examiner*—Stephen J. Novosad
*Assistant Examiner*—Michael A. Goodwin
*Attorney, Agent, or Firm*—Trexler, Bushnell & Wolters, Ltd.

[57] ABSTRACT

A mineral cutting device comprises a plurality of replaceable picks (10, 10A-10G) and associated water conveying lances (20, 20A-20G), each lance being of flexible, tubular synthetic plastics material having a hollow, water-conveying interior and being contained, at least partially, within a bore (13, 13A, 13B) in the pick (10, 10A-10G) when the pick (10, 10A-10G) has been mounted on the device (1, 1A, 1B), to line the bore and prevent water pressure within the lance being effective on the pick, with a terminal end of each lance provided with a metallic nozzle secured in water sealing manner thereto and providing a water discharge orifice (23). The invention further includes a lance (20, 20A-20G) for use with the mineral cutting device defined above, and also a shank bore (13B) formed at least partially in a side (27) of the pick shank (12, 12A-12D), which, in use, is the compressive stress side, and/or with an inner bore end (15) intersected by a slot (42) provided in at least a portion of the shank (12D).

33 Claims, 15 Drawing Figures

MINERAL CUTTING DEVICE

This invention relates firstly to a mineral cutting device of the kind provided with a plurality of replaceable picks, tools or chisels (all collectively referred to hereinafter as "picks"), each having head provided with a hard material cutting tip or insert e.g. of tungsten carbide, secondly to a lance for such device and such picks, and thirdly to a pick for such a device.

The device may be either for mineral (coal, potash etc.) winning purposes, taking the form of either a rotary cutting head e.g. mounted on a shearer type mining machine or on a trepanner type mining machine, or alternatively of a mineral plough; or alternatively may be for rock cutting purposes, taking the form of a rotary cutting head and mounted on a roadheader type machine e.g., for driving underground roadways or tunnels.

It is desirable to provide a water supply to a pick, or to the vicinity of the pick, for various purposes such as dust suppression, pick cooling, pick face flushing, prestart warning, so called incendive sparking elimination (viz., to suppress or eliminate local gas mixtures ignition), and, in more recent times, water jet assisted cutting, and whilst such water supply could be from a remote nozzle, alternative proposals have been to pass water through the pick itself. Understandably, the mining industry has adopted over the years a number of standardised picks, vast numbers of which, and their associated standardised holders or boxes (hereinafter referred to as "holder") and latching arrangements are already in service, but converting such standardised picks to for water through flow has not proved possible. In detail, known picks with water through-flow constructions as shown for example in the following patents, GB 1006819, GB 1057830, GB 2088441, GB 2142676 and GB 2142064. These prior art constructions include the drilling of a water conveying bore along the pick, the bore extending from a water discharge end(s) (located behind the cutting tip, and/or in front of the cutting tip, or to the sides of the cutting tip) to a water inlet end, usually located in a shank of the pick, the shank being insertable into an aperture of corresponding cross-section in a pick holder or box, with the pick shank releasably retained within its aperture by a latching arrangement. Various proposals have been suggested for providing a water tight connection between the water inlet end of the bore and a water supply source e.g. a conduit located within the mineral cutting device, but as such connection needs to take into account the inevitable play between successive replacement picks inserted into an increasingly worn holder aperture, no arrangement is without some drawbacks on the grounds of cost and/or reliability, ease of fitting etc. Furthermore, previous pick and holder proposals have usually resulted in water pressure tending to displace the pick from its holder and to negate the latching effect of the latching arrangement. Whilst pick proposals such as those exemplified above have advantageously resulted in water discharge being effected in an optimum location—in close proximity to the cutting tip—other proposals e.g., U.S. Pat. No. 3,747,982, have sought to avoid the need to drill a bore(s) in the pick by locating a water spray nozzle on the holder, but such nozzle is disadvantageously remote from the tip and consequently there is no guarantee that a water spray or jet reaches the vicinity of the tip.

According to a first aspect of the present invention, there is provided a mineral cutting device comprising a plurality of replaceable picks and associated water conveying lances each lance being tubular and having a hollow, water-conveying interior and being contained, at least partially, within a bore in the pick when the pick has been mounted on the device, and each lance terminating at or adjacent the end of the bore, at a water discharge orifice.

Thus, with the mineral cutting device in accordance with the invention, the conveyance of pressurised water by means of the lance ensures that there is no water pressure acting on the pick tending to dislodge the latter from its holder, and hence industry standard latching arrrangements can be used, while industry standard picks can also be employed, as the only modification necessary to a standard pick is the drilling of a bore to a diameter slightly greater than the external diameter of the lance, to ensure generally unimpeded passage of a lance along its bore particularly during insertion of a pick into its holder.

The mineral cutting device may take the form of either a rotary cutting head or a plough. The picks may be of a male type, provided with shanks or a female type provided with apertures. Male picks, and in particular their shanks, may be releasably fitted into apertures or sockets provided directly in the cutting device, or provided in holders welded onto the cutting device, while female picks may be releasably fitted onto a projection of the holder. The pick holders may be welded onto helical vanes in turn welded around an outer barrel part of a so-called spiral vane disc of a shearer type mining machine or alternatively may be welded directly to the exterior of a cutting head of a roadheader type machine.

Each lance is preferably releasably mounted on the device, so that a blocked/damaged lance may be cleaned/unblocked or replaced. Such releasable mounting is preferably by means of a mounting adaptor provided at the end of the lance remote from the discharge orifice, the adaptor having a bore serving either for the passage of water therethrough, to the hollow interior of the lance, or to receive a lance end. It is preferred to locate such an adaptor in a socket provided either in the mineral cutting device, or a portion of a vane of a spiral vane cutting head, or in an inner portion of a pick holder.

In a first adaptor embodiment, the socket may be tapped to receive a screw-in adaptor, which satisfactorily resists the displacing effect of the water pressure on the adaptor.

In a second adaptor embodiment, the latter is fitted into a non-tapped socket as a push fit, which avoids the need to thread both the socket and the adaptor. This embodiment of adaptor may be generally cylindrical to be a push or force fit into its socket with a central, co-axial bore to receive an end portion of the lance—preferably as a push or force fit to retain the lance in its adaptor. The adaptor conveniently has an enlarged head having an annular surface to seat on a radial end face or land of the rotary cutting device or pick holder, and hence to determine the extent of penetration of the adaptor into its socket. The latter may be substantially longer than the adaptor, so that a water seal may be interposed between an inner, reduced diameter end of the adaptor and an inner end of its socket. Preferably, the co-axial bore of the adaptor, in the region of the enlarged head is widened e.g. to frusto-conical shape, to provide clearance for the lance so that the latter may more readily engage a misaligned adjacent end of the bore of the pick and also be, in use, readily displaceable with the pick as the latter, in use, becomes progressively worn and hence progressively more moveable within its holder during mineral cutting operations. Apart from reducing manufacturing costs, this second adaptor embodiment also obviates any difficulty in releasing a rusted adaptor of a worn or damaged lance, but requires the presence of some retention means to resist the displacing effect of the water pressure. Such retention means may take several forms.

Thus, with one form, an inner portion of a shanked pick is arranged to abut the adaptor, when the pick is latched within its holder.

With another form, a collar of the adaptor, which collar is preferably enlarged, is arranged to be manoeuvred into a cup-like housing with a retaining surface, (which is preferably annular) of the enlarged collar engaging an undercut abutment surface of the housing. A water seal is required between the enlarged collar of the housing.

With yet another form, the arrangement incorporates the features of both the first and second embodiment and hence is suitable for use with higher water pressures.

With yet another form, suitable for yet higher pressures e.g. above 2,000 p.s.i., the adaptor may be mechanically latched into its housing by removable elements e.g. by use of a knock-in, knock out spring dowel(s) of a staple, engaging suitable holes, apertures or recesses.

With yet another form, the proposals of the mechanically latched form may be rendered further secure by incorporating the features of the pick-retained form.

According to a second aspect of the present invention, there is provided a lance for use with the mineral cutting device defined above, the lance comprising an elongate, tubular member having a hollow, water-conveying interior, one end of the lance being connected in a water sealing manner to a mounting adaptor by which the lance is, in use, releasably mounted on a portion of the cutting device or a pick holder thereof, in fluid flow communication with a supply source of pressurised water, the adaptor also being in fluid flow communication with the hollow interior of the lance, and the other end of the lance terminating in a water discharge orifice.

In detail, the lance may be approximately 100–200 mm in length, and although the lance could be of non-flexible tubing e.g., by being formed from metallic tubing, which is readily suitable for higher pressures e.g., 10,000 p.s.i., it is preferable for the lance to be flexible yet self-supporting e.g., by being formed of synthetic plastics material e.g., nylon tubing. The use of resilient, deformable nylon tubing is suitable for use with medium pressures, e.g. 500–1,500 p.s.i. It is of course desirable to select a grade and/or wall thickness for such tubing capable of accommodating substantial water pressures e.g. 500–1,500 p.s.i., or possibly higher. With the deflection inherent in a synthetic plastics lance, the latter can readily accommodate play between a pick and a worn holder which occurs in service, or, as may be required, may readily penetrate a dog-leg bore that it may be necessary or desirable to drill into some industry standard picks. For higher pressures, the tubing may be constructed partly from metallic materials and partly from synthetic plastics materials, or may be provided with or without an outer, supporting braid or band, to resist any ballooning effect on the lance when subjected to the water pressures. The lance may be provided with a coil spring protective and/or supporting sleeve over at least a portion of its length adjacent its adaptor. As debris absence from the water supply cannot be guaranteed, it is usually desirable to incorporate within the adaptor a filter, e.g., of wire mesh, to prevent debris entering and blocking the lance. The lance may be formed integrally with its adaptor e.g. by an injection moulding process, or the adaptor may be an initially separate metallic (e.g., steel) component secured in water sealing manner to the relevant lance end.

The lance preferably terminates in a water discharge nozzle having a reduced water outlet orifice compared with the cross sectional area of the hollow interior of the lance. With a synthetic plastic lance, the nozzle may be integrally moulded to the lance at a water discharge end thereof. Preferably, however a synthetic plastics lance is provided with a metallic discharge nozzle, secured in water sealing manner to the relevant lance end.

Considering the picks of rotary cutting heads, there have been several prior art proposals wherein the pick has been provided with a water conveying bore, as discussed earlier. In the case of a point-attack type pick intended to rotate, in use, about its longitudinal axis, the bore would normally, be co-axial with the longitudinal axis of the pick. However with two other commonly used picks viz. radial picks and forward attack picks, cutting forces applied to the pick, in use, result in tensile stress being generated within a leading side (having regard to the direction of rotation of the cutting head on which the pick is mounted) of the shank of the pick, and compressive stress being generated within a trailing side of the shank. Furthermore, in prior art proposals of radial or forward attack picks, the water conveying bores have usually been drilled either along the neutral access of the shank or through the tensile, high stress area of the pick, resulting in further weakening of the pick in this region.

According to a third aspect of the invention, there is provided, in a first embodiment, a mineral cutter pick comprising a head, an integral shank formed integrally with the head and a bore extending along at least portions of both the head and the shank, the shank bore being formed at least partially in a side of the shank, which, in use, is the compressive stress side.

Thus, the pick in accordance with this first embodiment avoids formation of the bore in the tensile high stressed side of the shank, by positively ensuring that it is formed in the compressive stressed side.

The pick may be of a radial type, of a forward attack type, or of a non-rotatable, point attack type, and preferably the head thereof has a tungsten carbide cutting tip. In detail, the bore may be a single, longitudinal bore, or of a two part, dog-leg type comprising a first bore part formed wholly or substantially within the shank intersecting a second bore part formed wholly or substantially within the head. With either arrangement, an outlet end of the pick bore is located in a region of the head behind the tip, in the cutting direction.

According to a fourth aspect of the invention, there is provided, in a second embodiment, a mineral cutter pick comprising a head provided with a hard material cutting tip, and a shank formed integrally with the head, a bore provided along at least the pick head with an outer bore end located rearwardly of the cutting tip, and an inner bore end intersected by a slot provided at least in a portion of the shank.

The above defined second embodiment of pick provides for minimum modification to an industry standard pick, simply requiring a single bore to be drilled through the head and a slot to be cut into the shank such that the slot intersects the inner end of the bore.

The pick bore is of course intended to house a portion of a flexible, water conveying lance as defined previously, the lance having a water discharge orifice locatable adjacent the outer end of the bore. The slot may be simply produced by sawing, preferably into a shank of rectangular cross-section, whilst the bore is preferably drilled along the compressive stress side of the head.

The various aspects of the invention will now be described, by way of examples, with reference to the accompanying drawings, in which:

FIG. 1 is a side elevation of a first embodiment of mineral cutting device, a first embodiment of lance, and a first embodiment of pick in accordance with the invention.

FIG. 2 corresponds to FIG. 1, but shows second embodiments of cutting device, lance and pick;

FIG. 3 corresponds to FIG. 2, but shows a third embodiment of lance;

FIG. 4 corresponds to FIG. 2, but shows a fourth embodiment of lance;

FIG. 5 corresponds to FIG. 2, but shows a fifth embodiment of lance;

FIG. 6 corresponds to FIG. 1 but shows a third embodiment of cutting device and sixth embodiment of lance and a third embodiment of pick;

FIG. 7 is a view in the direction of arrow A of FIG. 6;

FIG. 8 corresponds to FIG. 1, but shows fourth embodiments of cutting device and of pick;

FIG. 9 corresponds to FIG. 2, but shows a seventh embodiment of lance and a fifth embodiment of pick;

Figure 9:
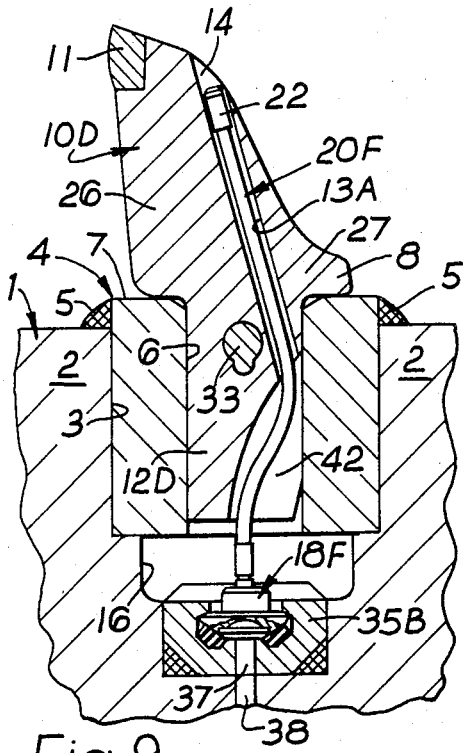
Figure 12:
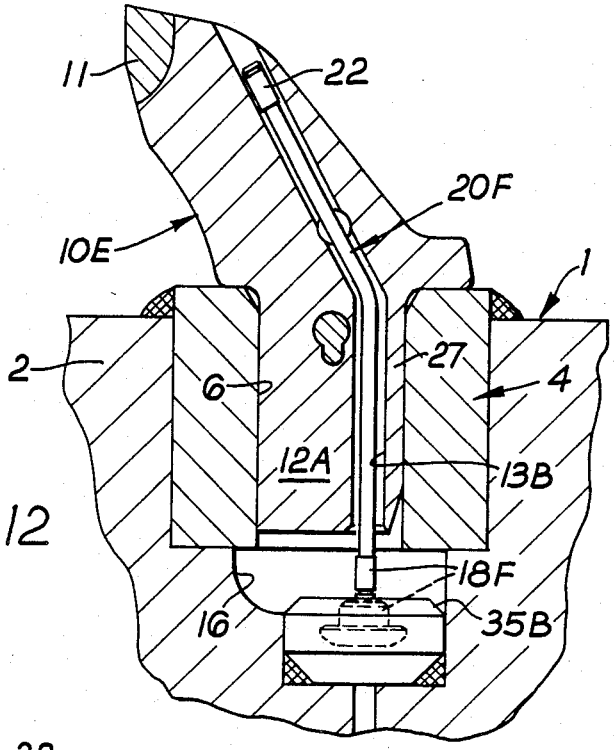
Figure 13:
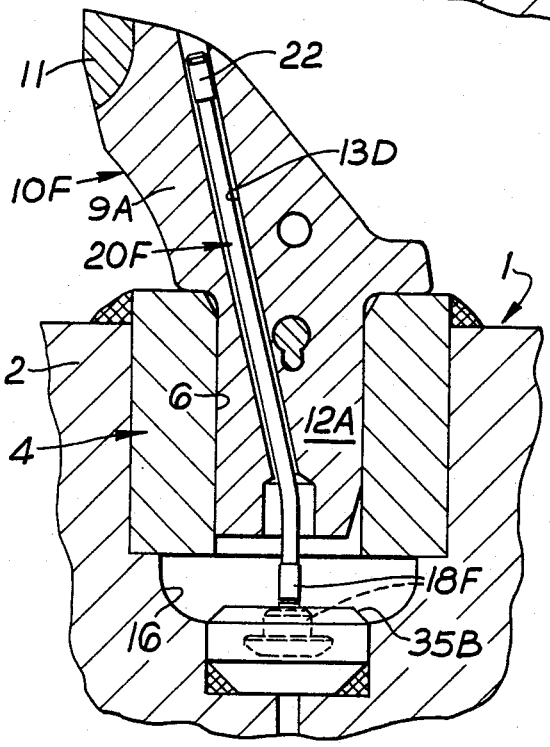
Figure 14:
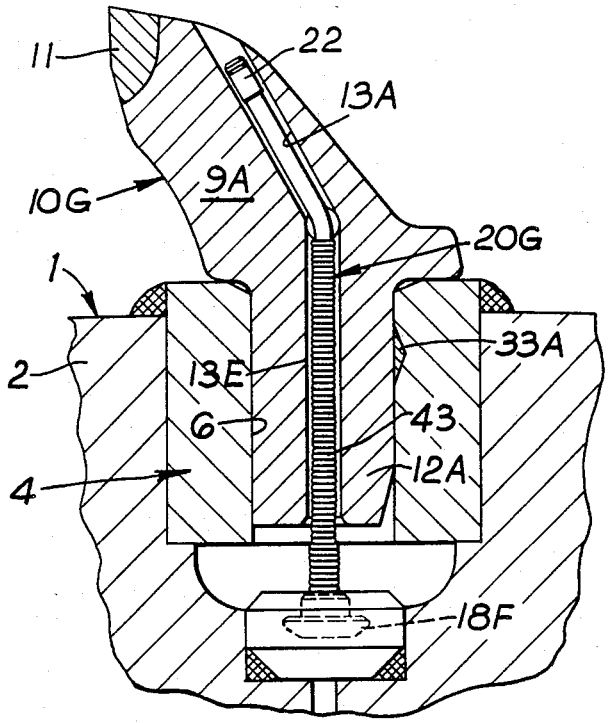

FIGS. 12 and 13 correspond to FIG. 9 but show, respectively sixth and seventh embodiments of pick;

FIG. 14 corresponds to FIG. 9 but shows an eighth embodiment of pick; and

Figure 15:
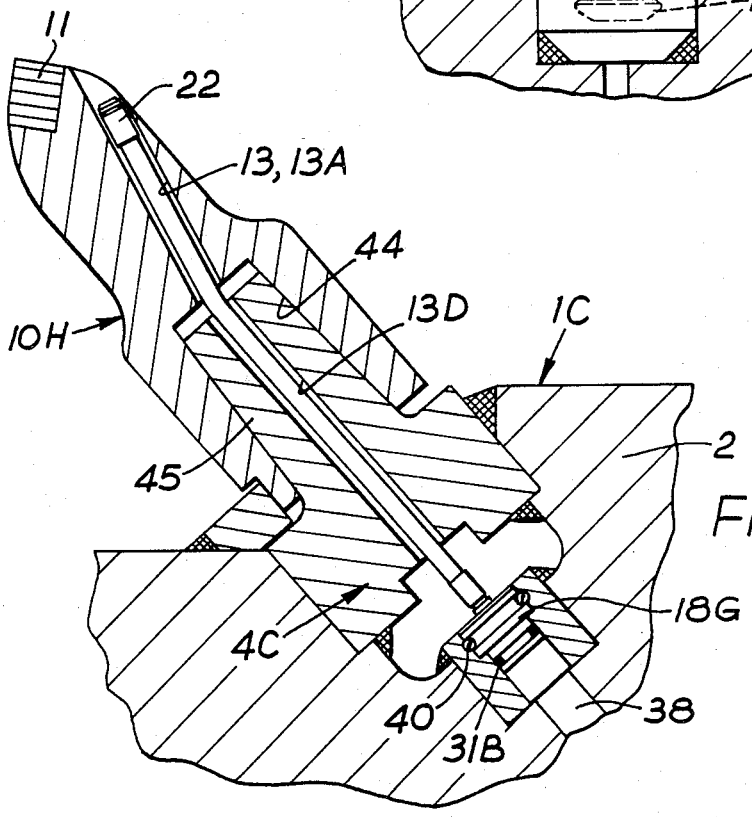

FIG. 15 shows a fifth embodiment of cutting device, and eighth embodiment of lance and a nineth embodiment of pick.

In all Figures, like components are accorded like reference numerals, but with the suffix A, B, C etc., for modified versions of the same component.

Figure 1:
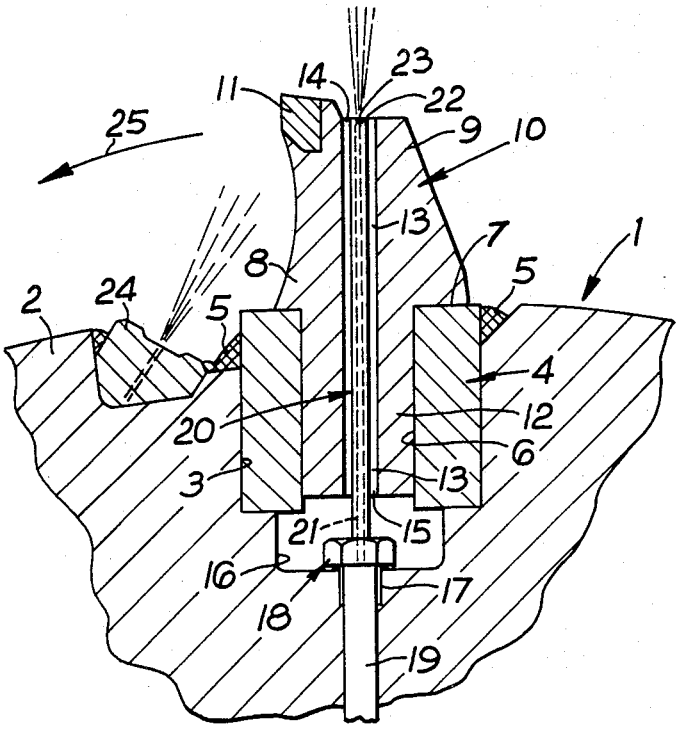

In FIG. 1 is illustrated a portion of a mineral cutting device in the form of a rotary cutting head 1, for the winning of mineral such as coal, potash etc., and conventionally comprising a barrel part (not shown). mounted on a drive arbour of a mining machine, with a spiral vane 2 serving, in the well known manner, to assist loading of cut mineral onto a conveyor associated with the mining machine. The vane 2 is provided at various locations around its periphery with a plurality of notches, one notch 3 being illustrated in FIG. 1, into each of which notches is located a pick-holder 4 secured to the vane 2 by weld metal 5. Each holder 4 has an aperture 6 and, at an outer edge, a seating face 7 for a shoulder 8 of an enlarged head 9 of a mineral cutter pick 10, the head 9 being provided with a tungsten carbide cutting tip 11. Extending integrally from the head 9 is a rectangular section pick shank 12 of external profile corresponding to the cross-section of the aperture 6, whilst a bore 13 is drilled through both the head 9 and shank 12 to provide an outer bore end 14 located rearwardly of the tip 11, and an inner bore end 15 located in the vicinity of an inward extension 16 of the notch 3, which extension is provided with a socket 17 which is tapped to receive a screw threaded, metallic mounting adaptor 18. The latter is connected by tube 19 to a source of pressurised water, and is connected in a water sealing manner e.g., by crimping, to a tubular lance 20 in the form of a steel tube, with the lance 20 at least partially contained within its bore 13. The external diameter of the lance 20 and the diameter of the bore 13 are such that firstly the lance may be readily fitted into the bore 13, and secondly sufficient clearance is provided to accommodate pick movements which will occur in service as the aperture 6 becomes progressively worn. The lance 20 has a hollow, water-conveying interior 21 along which pressurised water is conveyed to a discharge nozzle 22 located at an outer terminal end of the lance 20 and having a reduced outlet orifice 23, the lance length being such that the nozzle 22 is located adjacent the outer end 14 of the bore 13. It will be appreciated that pressurised water is prevented from acting upon the pick 10 in a manner that would tend to dislodge the pick from its holder 4, because the pressurised water is confined within the lance 20. Also illustrated in FIG. 1 is a conventional spray nozzle 24 located in advance of the pick 8, should a water spray be required to the area in advance of the tip 11, the head 1 being rotatable anti-clockwise, as indicated by arrow 25.

Figure 2:
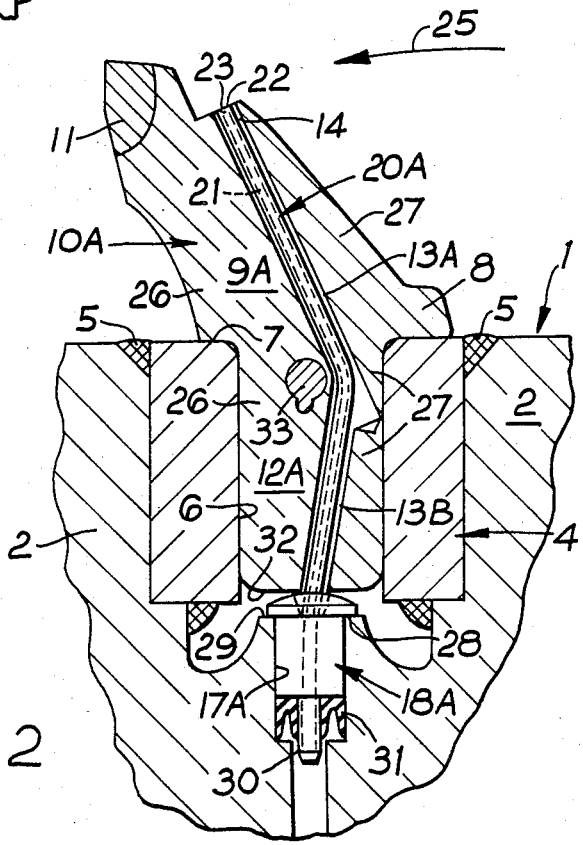

In FIG. 2 is illustrated a pick 10A having a dog-leg bore, comprising a first bore part 13A located principally in the head 9A, and in communication with a second bore part 13B located principally within the shank 12A. As the head 1 is again rotatable in an anti-clockwise direction as indicated by the arrow 25, a leading side 26 of the pick experiences tensile stresses upon being forced into the mineral being won, and a trailing side 27 of the pick experiences compressive stresses, and in accordance with the second aspect of the invention, at least the bore part 13B is provided in the compressive stress side of the shank.

Also illustrated in FIG. 2 is a second embodiment of lance/mounting in which the requirement for the tapped socket 17 of the FIG. 1 embodiment is eliminated. The lance 20A is of flexible, self-supporting tubing e.g., of nylon (trade mark). In this embodiment a plain hole 17A is provided and the mounting adaptor 18A is of metal or synthetic plastics and is a push-fit into the hole 17A, having an annular surface 28 seating on a radial end face 29 of the vane 2. The adaptor 18A has an inner end 30, of reduced diameter, engaging a portion of a water seal 31. The adaptor 18A is retained in its socket 17A against the action of the water pressure by an inner portion 32 of the shank 12A abutting the adaptor 18A, with an industry standard latching means 33, thus serving not only to latch the pick 10A releasably within its holder 4, but also to retain the adaptor 18A within its socket 17A.

Figure 3:
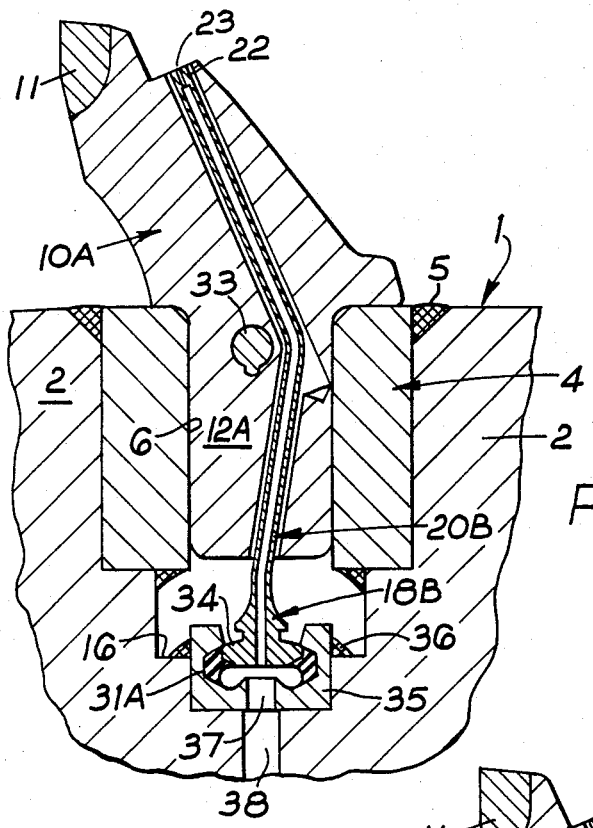

In the embodiment of FIG. 3, the adaptor 18B e.g. of nylon, is formed integrally with the lance 20B e.g., by injection moulding, with an enlarged portion 34 of the adaptor 18B manoeuvrable into a cup-like housing 35 secured by weld metal 36 in the inward extension 16, with a water seal 31A located between the enlarged portion 34 and the housing 35, the latter also being provided with a water inlet port 37 in fluid flow communication with a water supply bore 38 provided in the vane 2 and connected to a source of pressurized water.

Figure 4:
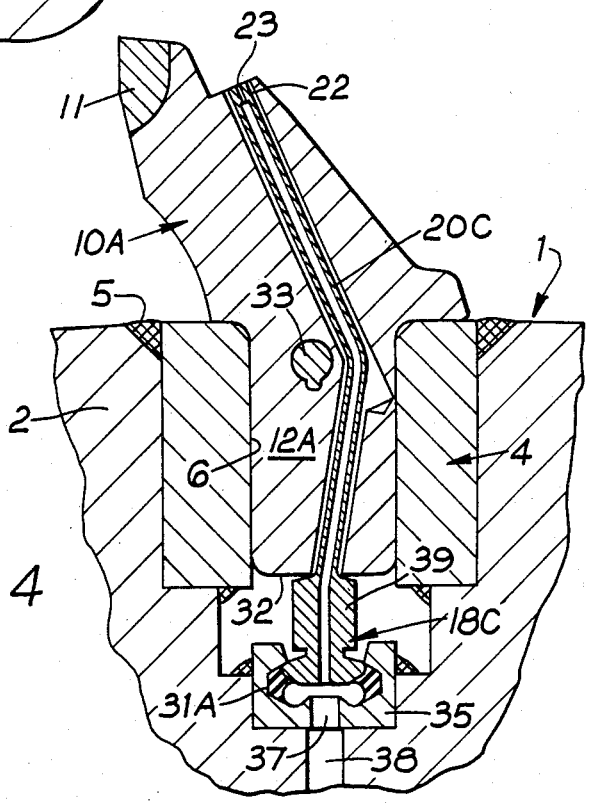

In the embodiment of FIG. 4, the adaptor 18C of the lance 20C is provided with an extension portion 39 in engagement with the inner portion 32 of the shank 12A of the pick 10A, to provide additional means of retaining this adaptor in position.

Figure 5:
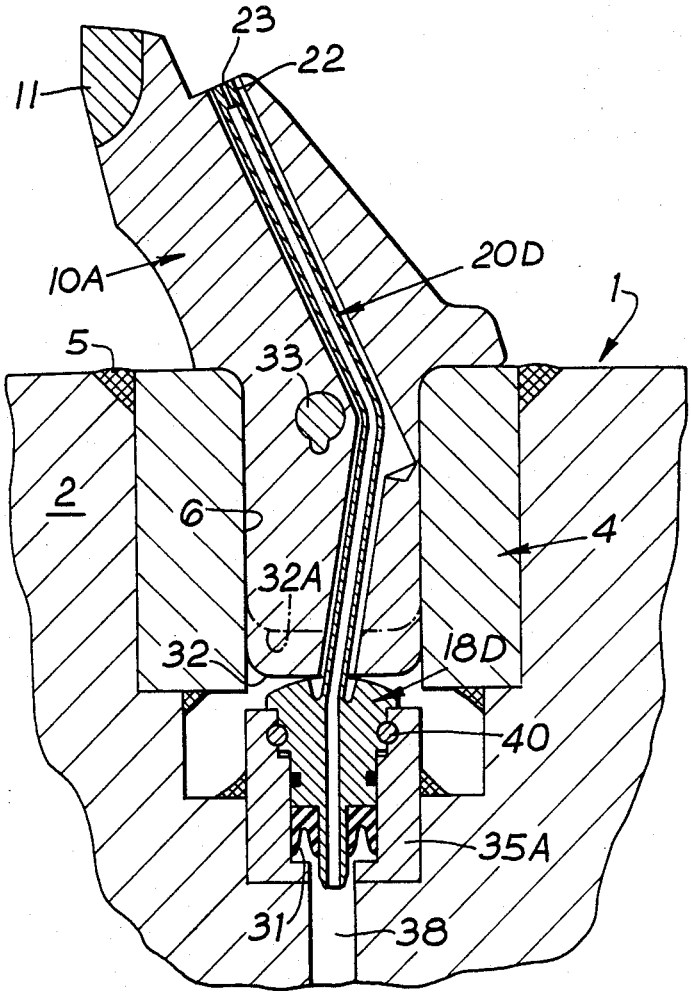

In the embodiment of FIG. 5, the adaptor 18D is again illustrated as integral with its lance 20D being located within a cup-like housing 35A by means of a "U"-shaped staple 40 engaging both an external groove in the adaptor 18D and an internal groove in the housing 35A. Additional retention of the adaptor 18D against water pressure may be provided by the inner portion 32 of the shank 12A, or in an alternative embodiment, where no such secondary retention is required, then as indicated at 32A, the inner portion of the shank may be spaced from the adaptor 18D.

Figure 6:
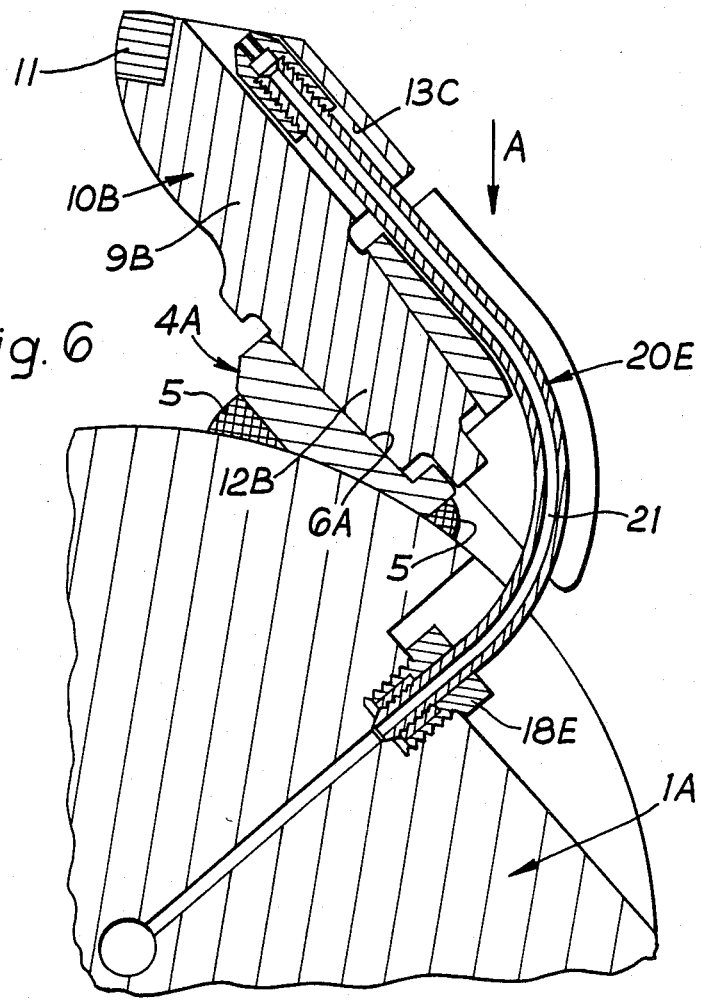
Figure 7:
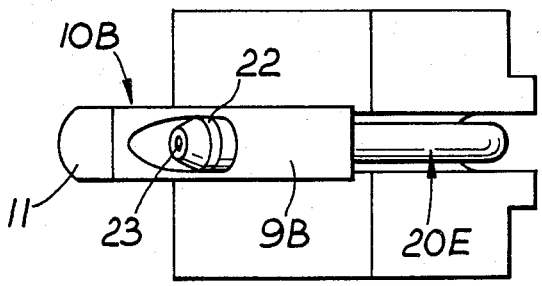

The embodiment of FIGS. 6 and 7 illustrates an arrangement of rotary cutting head 1A suitable for a roadheader type of machine i.e. a pick holder 4A is secured by weld metal 5 directly to the external periphery of the cutting head 1A, in contrast to being welded to a helical vane as shown in the embodiments of FIGS. 1 to 5. Furthermore, in contrast to the embodiments of FIGS. 1 to 5, firstly aperture 6A and shank 12B of pick 10B are frusto-conical and secondly no bore 13, 13A, 13B, is provided in the pick shank 12B, but bore 13C is provided in the pick head 9B. One lance end is sealingly secured to a radially located adaptor 18E which makes a double-threaded connection with the cutting head 1A, the lance 20E being curved from its radial mounting to a tangential location.

Figure 8:
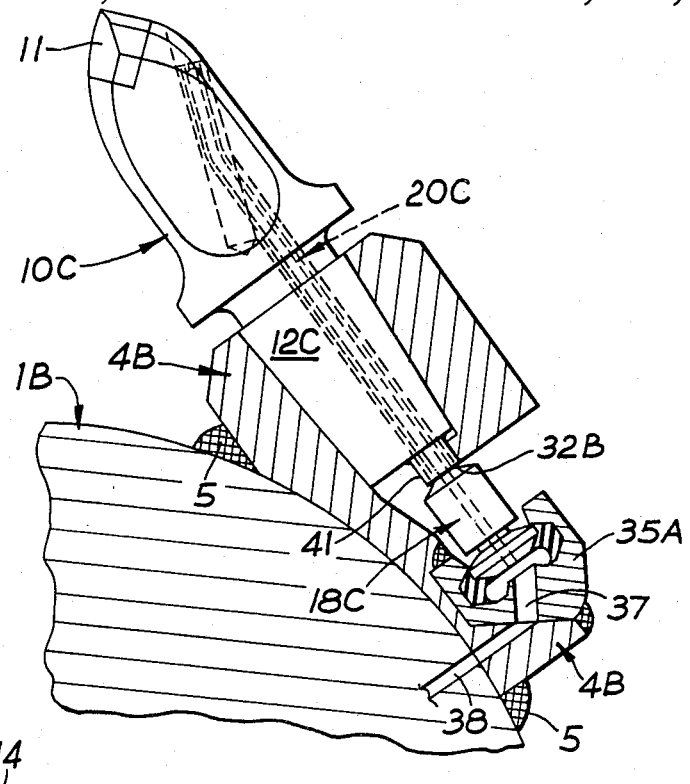

With the embodiment of FIG. 8, pick holder 4B is again welded to the external periphery of a cutting head 1B suitable for a roadheader type of machine, with a cup-like housing 35A welded to the pick holder 4B, while the adaptor 18C and lance 20C are of the form shown in FIG. 4, with inner portion 32B of an extension 41 of the shank 12C of pick 10C in engagement with the adaptor 18C.

Figure 10:
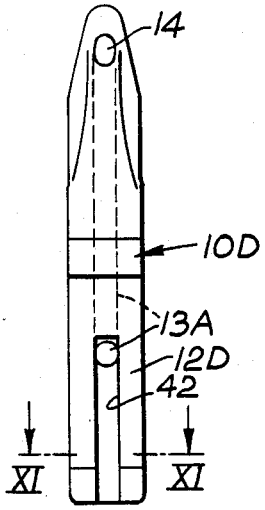
FIG. 10 is an end elevation of the pick of FIG. 9.
Figure 11:
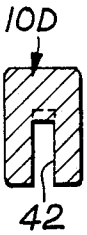
FIG. 11 is a section on the line XI—XI of FIG. 10.

In the embodiment of FIGS. 9 to 11, a slot 42 is sawn into rectangular shank 12D of pick 10D, which slot is in communication with bore part 13A. The lance 20F is of nylon tube, with outer, burst-resistant braid. Adaptor 18F is locatable within the cup-like housing 35B, as described in connection with FIG. 3, whilst the adaptor 18F is provided with a debris filter 46.

In the embodiment of FIG. 12, bore part 13B is drilled along the compressive stress side 27 of the shank 12A of pick 10E, parallel to the longitudinal axis of the shank 12A.

In the embodiment of FIG. 13, a single bore 13D is drilled angularly through both the head 9A and shank 12A of pick 10F.

In the embodiment of FIG. 14, a bore part 13E is drilled along the neutral axis of the shank 12A of pick 10G, to insert bore part 13A of the head 9A, while an alternative industry standard latching mens is indicated at 33A. Furthermore, lance 20G is provided externally, over a portion of its lenth extending from its adaptor 18F, with a coil spring protective sheath 43 serving not only to protect the lance 20G, of nylon for example, from any damage during pick insertion, but also to increase the self-supporting action of the lance 20G.

In the embodiment of FIG. 15, is illustrated a female pick 10H having a frusto-conical aperture 44 mounted on a male holder 4C having a corresponding frusto-conical projection 45 of an embodiment 1C of cutting head. The adaptor 18G is releasably retained by a "V"-shaped staple 40, with a water seal 31B, while the holder 4C is provided with a lance-accommodating bore part 13D.

What I claim is

1. A mineral cutter pick for use with a mineral cutting device, said pick comprising a head, a hard material cutting tip provided on said head, and a shank formed integrally with said head, a bore provided along at least said head, with an outer end of said bore located rearwardly of said cutting tip, and an inner end of said bore intersected by a slot provided in at least a portion of said shank, said slot extending from a terminal end of said shank remote from said head to a rear face of said shank with respect to the cutting direction.

2. A pick as claimed in claim 1, wherein said bore is provided in a side of the head which, in use, is the compressive side.

3. A mineral cutting device comprising; a plurality of replaceable picks, a hard material cutting tip provided on each pick, a bore provided in each pick having an open bore end in the vicinity of each of said tips and extending therefrom, and a plurality of associated water conveying lances, each of said lances being of flexible tubular, synthetic plastics material having a hollow, water-conveying interior and being contained, at least partially, within said bore of one of said picks when said pick has been mounted on said device to line substantially the entire length of said bore and to prevent water pressure within said lance being effective on said pick, so as to substantially prevent the buildup of hydraulic pressure within the pick which would tend to dislodge the pick from the cutting device, with a terminal end of each lance being provided with a metallic nozzle secured in water sealing manner to said terminal end and providing a water discharge orifice closely adjacent said open bore end.

4. A device as claimed in claim 3, in the form of a rotary cutting head.

5. A device as claimed in claim 3, wherein said picks are of a male type, provided with shanks.

6. A device as claimed in claim 5, wherein pick holders, provided with sockets, are welded onto the cutting device and said shanks are fitted into said sockets.

7. A device as claimed in claim 3, wherein said picks are of a female type, provided with apertures.

8. A device as claimed in claim 3, wherein said lances are releasably carried by said device.

9. A mineral cutting device according to claim 3 wherein each said lance comprises an elongate, flexible, self-supporting elongate tubular member having a hollow, water-conveying interior, and a mounting adaptor connected in water sealing manner to one end of said lance by which adaptor said lance is, in use, releasably mounted on a portion of said cutting device in fluid flow communication with a supply source of pressurized water, said adaptor also being in fluid flow communication with said hollow interior of the lance.

10. A mineral cutting device comprising; a plurality of replaceable picks, a hard material cutting tip provided on each pick, a bore provided in each pick having an open bore end in the vicinity of each of said tips and extending thereform, and a plurality of associated water conveying lances, each of said lances being of a flexible tubular, synthetic plastics material having a hollow, water-conveying interior and being contained, at least partially, within said bore of one of said picks when said pick has been mounted on said device to line substantially the entire length of said bore and to prevent water pressure within said lance being effective on said pick so as to substantially prevent the buildup of hydraulic pressure within the pick which would tend to dislodge the pick from the cutting device, with a terminal end of each lance being provided with a metallic nozzle secured in water sealing manner to said terminal end and providing a water discharge orifice adjacent said bore end and, at an end remote from its discharge orifice, each of said lances being provided with a mounting adaptor, the adaptor having a bore.

11. A device as claimed in claim 10, wherein a plurality of sockets are provided on said device in each of which sockets one of said adaptors is located.

12. A device as claimed in claim 11, wherein said picks are of a male type, provided with shanks and each of said adaptors is retained in its socket by an inner portion of an associated pick shank abutting said adaptor.

13. A device as claimed in claim 11, wherein a water seal is provided between said adaptor and its socket.

14. A device as claimed in claim 11, wherein an enlarged collar is provided on said adaptor and a cup-like housing is provided on said device, said adaptor being manoevrable into said cup-like housing, and the latter providing a retaining surface, a water seal located between said enlarged collar and said housing.

15. A device as claimed in claim 11, wherein removable elements serve to latch said adaptor into its housing.

16. A mineral cutting device according to claim 10 wherein each said lance comprises an elongate, flexible, self-supporting elongate tubular member having a hollow, water-conveying interior, said mounting adaptor is connected in a water sealing manner to one end of said lance and by which adaptor said lance is, in use, releasably mounted on a portion of said cutting device in fluid flow communication with a supply source of pressurized water, said adaptor bore also being in fluid flow communication with said hollow interior of the lance.

17. A lance for use with a mineral cutting device, said lance comprising an elongate, flexible, self-supporting tubular member having a hollow, water-conveying interior, a mounting adaptor connected in water sealing manner to one end of said lance by which adaptor said lance is, in use, releasably mounted on a portion of said cutting device in fluid flow communication with a supply force of pressurized water, said adaptor also being in fluid flow communication with said hollow interior of the lance, and a metallic nozzle secured in water sealing manner to the other end of said lance and providing a water discharge orifice.

18. A lance as claimed in claim 17, formed from non-flexible, metallic tubing.

19. A lance as claimed in claim 17, formed from flexible, self-supporting tubing.

20. A lance as claimed in claim 17, provided with a coil spring protective and/or supporting sleeve over at least a portion of its length adjacent its adaptor.

21. A lance as claimed in claim 17, wherein a filter is incorporated within said adaptor.

22. A lance as claimed in claim 17, said lance being formed integrally with its mounting adaptor.

23. A lance as claimed in claim 17, wherein said adaptor is an initially separate, metallic component secured in water sealing manner to said one end of said lance.

24. A lance as claimed in claim 17, wherein said orifice of said water discharge nozzle is substantially reduced compared with the cross-sectional area of said hollow interior of said lance.

25. A lance as claimed in claim 24, wherein said nozzle is integrally moulded to said lance.

26. A mineral cutter pick for use with a mineral cutting device, said pick comprising a head, a hard material cutting tip provided on said head, and a shank formed integrally with said head, a bore provided in said pick having an open bore end in the vicinity of said tip and extending therefrom, said bore being formed in a side of the shank which, in use, is the compressive stress side; and a water conveying lance, said lance being of flexible tubular, synthetic plastics material having a hollow, water-conveying interior and being contained, at least partially within said bore of said pick when said pick has been mounted on said device to line substantially the entire length of said bore and to prevent water pressure within said lance being effective on said pick, so as to substantially prevent the buildup of hydraulic pressure within the pick which would tend to dislodge the pick from the cutting device, with a terminal, water discharge, end of said lance being provided with a metallic nozzle secured in water sealing manner to said terminal end and providing a water discharge orifice closely adjacent said open bore end.

27. A pick as claimed in claim 26, of the radial type.

28. A pick as claimed in claim 26, of the forward attack type.

29. A pick as claimed in claim 26, provided with a tungsten carbide cutting tip.

30. A pick as claimed in claim 29, wherein an outlet end of said pick bore is located in a region of said head behind said tip, with respect to the cutting direction.

31. A pick as claimed in claim 26, incorporating a single longitudinal bore.

32. A pick as claimed in claim 26, incorporating a two-part, dog-leg bore, comprising a first bore part formed substantially wholly within said shank and intersecting a second bore part formed substantially wholly within said head.

33. A mineral cutter pick for use with a mineral cutting device, said pick comprising a head, a hard material cutting tip provided on said head, and a shank formed integrally with said head, a bore provided in said pick having an open bore end in the vicinity of said tip and extending therefrom; said bore being formed in a side of said shank which, in use, is the compressive stress side; and said bore being adapted, in use, to receive a water conveying lance of flexible tubular, synthetic plastics material having a hollow, water-conveying interior, with a terminal end of said lance being provided with a metallic nozzle secured in water sealing manner to said terminal end; to prevent water pressure within said lance being effective on said pick, so as to substantially prevent the buildup of hydraulic pressure within the pick which would tend to dislodge the pick from the cutting device.

* * * * *